US009708897B2

(12) United States Patent
Menon et al.

(10) Patent No.: US 9,708,897 B2
(45) Date of Patent: Jul. 18, 2017

(54) OILFIELD APPLICATION FRAMEWORK

(71) Applicant: Schlumberger Technology Corporation, Sugar Land, TX (US)

(72) Inventors: Shashi Menon, Oslo (NO); Eric Jonathan Schoen, Bellaire, TX (US); Amit Lodh, Houston, TX (US); Truls Arnegaard, Oslo (NO); Stephen Whitley, Katy, TX (US); Keith Tushingham, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 790 days.

(21) Appl. No.: 13/943,820

(22) Filed: Jul. 17, 2013

(65) Prior Publication Data

US 2013/0327521 A1 Dec. 12, 2013

Related U.S. Application Data

(63) Continuation of application No. 12/535,340, filed on Aug. 4, 2009, now Pat. No. 8,499,829.

(60) Provisional application No. 61/091,207, filed on Aug. 22, 2008.

(51) Int. Cl.

| | |
|---|---|
| ***G06G 7/48*** | (2006.01) |
| ***E21B 44/00*** | (2006.01) |
| ***E21B 41/00*** | (2006.01) |

(52) U.S. Cl.

CPC ..... *E21B 44/00* (2013.01); *E21B 41/00* (2013.01)

(58) Field of Classification Search

CPC ..... E21B 44/00; E21B 41/00

USPC ..... 703/10

See application file for complete search history.

(56) References Cited

U.S. PATENT DOCUMENTS

| | | | | |
|---|---|---|---|---|
| 5,992,519 | A | 11/1999 | Ramakrishnan et al. | |
| 6,018,497 | A | 1/2000 | Gunasekera | |
| 6,078,869 | A | 6/2000 | Gunasekera | |
| 6,106,561 | A * | 8/2000 | Farmer | G01V 1/282 345/423 |
| 6,230,101 | B1 * | 5/2001 | Wallis | G06T 17/00 702/14 |
| 6,313,837 | B1 | 11/2001 | Assa et al. | |
| 6,826,483 | B1 | 11/2004 | Anderson et al. | |

(Continued)

FOREIGN PATENT DOCUMENTS

| | | |
|---|---|---|
| GB | 2335158 A | 9/1999 |
| WO | 9964896 A1 | 12/1999 |

(Continued)

OTHER PUBLICATIONS

Szpuszta, M., "Designing Smart Clients Based on CAB and SCSF", Microsoft Corporation, Dec. 2006, 56 pages.

*Primary Examiner* — Omar Fernandez Rivas
*Assistant Examiner* — Iftekhar Khan
(74) *Attorney, Agent, or Firm* — Colin Wier

(57) ABSTRACT

A method for performing an oilfield operation of an oilfield having a subterranean formation. The method includes collecting oilfield data and deploying a first plug-in including a first oilfield technology functionality into an oilfield hosting application. The method further includes performing an oilfield analysis on the collected oilfield data in the oilfield hosting application using the first oilfield technology functionality of the first plug-in to generate an oilfield output and adjusting an oilfield operation based on the oilfield output.

20 Claims, 8 Drawing Sheets

(56) References Cited

U.S. PATENT DOCUMENTS 6,980,940 B1 * 12/2005 Gurpinar ..... E21B 43/00 166/250.16
7,142,986 B2 11/2006 Moran
7,164,990 B2 1/2007 Bratvedt et al.
7,248,249 B2 7/2007 Kong et al.
7,248,259 B2 7/2007 Fremming
8,214,243 B2 * 7/2012 Graham ..... G06Q 10/06 705/7.22
8,499,829 B2 8/2013 Menon et al.
2003/0132934 A1 * 7/2003 Fremming ..... G01V 1/30 345/419
2003/0216897 A1 * 11/2003 Endres ..... G01V 11/00 703/10
2004/0220846 A1 11/2004 Cullick et al.
2004/0221261 A1 * 11/2004 Blevins ..... G06Q 10/06 717/107
2005/0149307 A1 7/2005 Gurpinar et al.
2006/0129366 A1 * 6/2006 Shaw ..... E21B 49/006 703/10
2006/0184329 A1 8/2006 Rowan et al.
2006/0197759 A1 9/2006 Fremming
2007/0061087 A1 3/2007 Ghorayeb et al.
2007/0112547 A1 5/2007 Ghorayeb et al.
2007/0199721 A1 * 8/2007 Givens ..... G06Q 10/06 166/382
2007/0299643 A1 * 12/2007 Guyaguler ..... G01V 11/00 703/10
2008/0109490 A1 5/2008 Arnegaard et al.
2008/0172272 A1 7/2008 Back et al.
2009/0020284 A1 * 1/2009 Graf ..... E21B 44/00 166/250.15
2009/0089028 A1 * 4/2009 Sagert ..... E21B 47/00 703/6
2009/0152005 A1 * 6/2009 Chapman ..... E21B 7/00 175/24
2010/0049490 A1 * 2/2010 Watters ..... E21B 43/00 703/10

FOREIGN PATENT DOCUMENTS

WO 2004049216 A1 6/2004
WO 2005122001 A1 12/2005

* cited by examiner

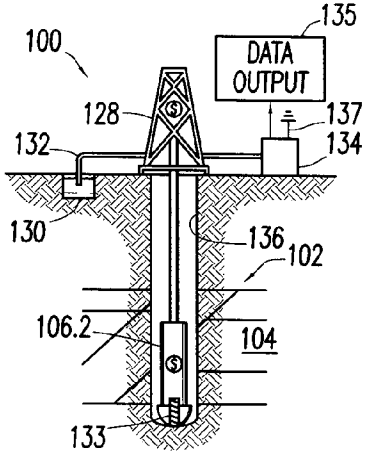
FIG. 1.2
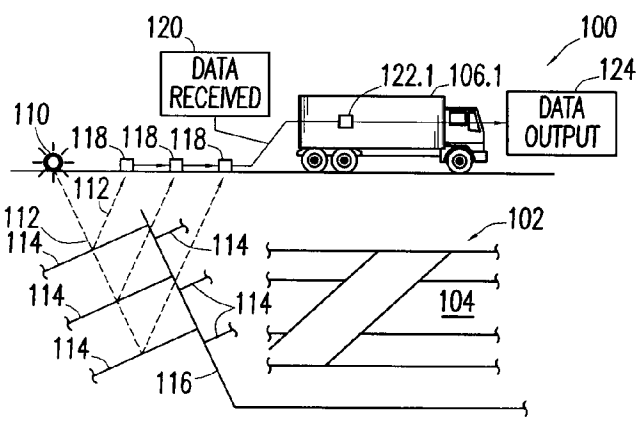
FIG. 1.1
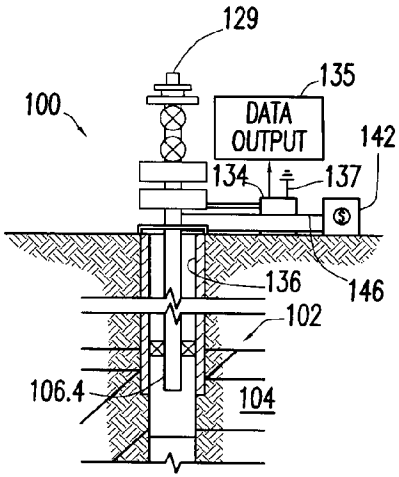
FIG. 1.4
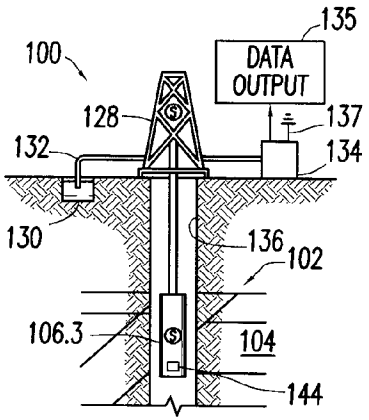
FIG. 1.3

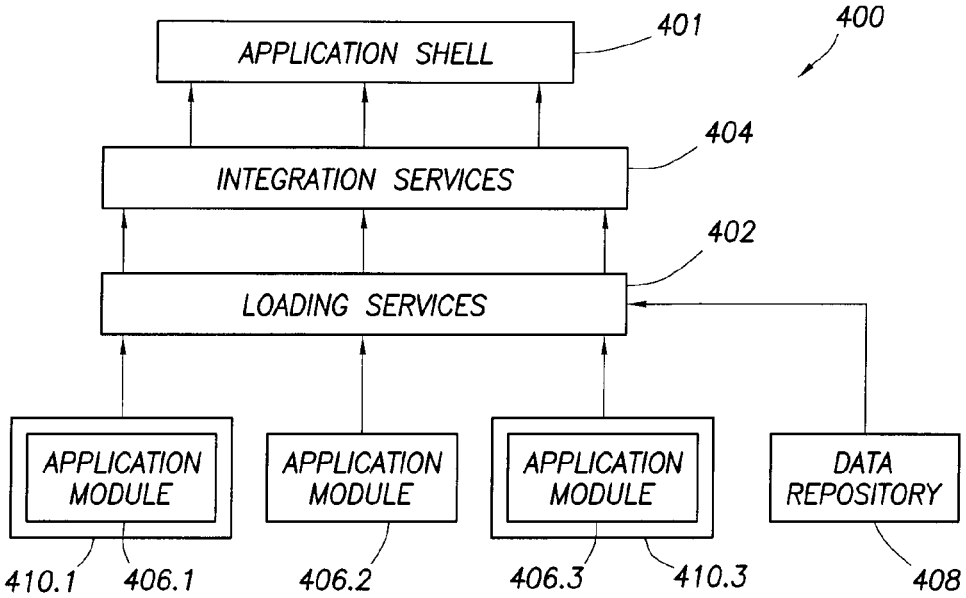
FIG.4.1
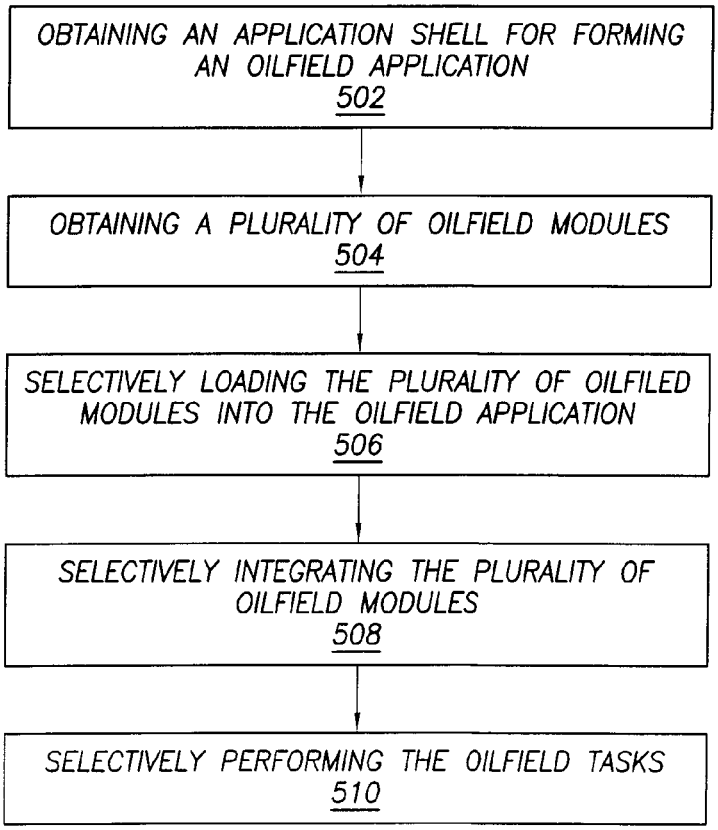
FIG.5

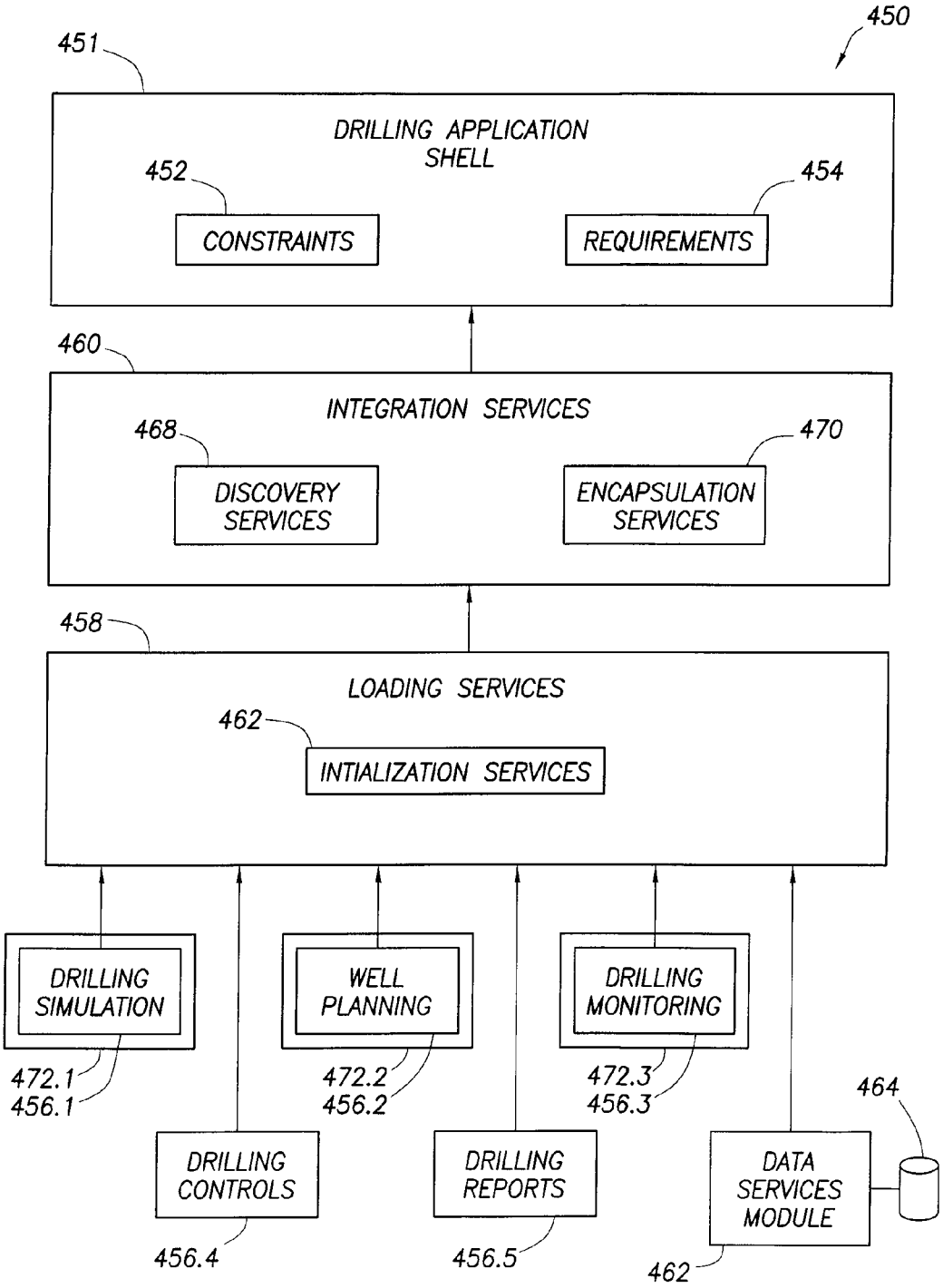
FIG. 4.2

OILFIELD APPLICATION FRAMEWORK

CROSS-REFERENCE TO RELATED APPLICATION

This application claims priority, to U.S. patent application Ser. No. 12/535,340 filed Aug. 4, 2009 entitled "Oilfield Application Framework" (now U.S. Pat. No. 8,499,829, issued Aug. 6, 2013) and to U.S. Patent Application Ser. No. 61/091,207, entitled "System and Method for Performing Oilfield Operations," filed on Aug. 22, 2008, which is hereby incorporated by reference in its entirety.

BACKGROUND

Operations, such as surveying, drilling, wireline testing, completions, production, planning and field analysis, are typically performed to locate and gather valuable downhole fluids. Surveys are often performed using acquisition methodologies, such as seismic scanners or surveyors to generate maps of underground formations. These formations are often analyzed to determine the presence of subterranean assets, such as valuable fluids or minerals, or to determine whether the formations include characteristics suitable for storing fluids.

During drilling and production operations, data is typically collected for analysis and/or monitoring of the operations. Such data may include, for instance, information regarding subterranean formations, equipment, and historical and/or other data.

Typically, simulators are designed to model specific behavior of discrete portions of the wellbore operation. Due to the complexity of the oilfield operation, most simulators are capable of only evaluating a specific segment of the overall production system, such as simulation of the reservoir. Simulations of portions of the wellsite operation, such as reservoir simulation, flow through the wellbore or surface processing, are usually considered and used individually.

A change in any segment of the production system, however, often has cascading effects on the upstream and downstream segments of the production system. For example, restrictions in the surface network can reduce productivity of the reservoir. Separate simulations typically fail to consider the data or outputs of other simulators, and fail to consider these cascading effects.

SUMMARY

A method for performing an oilfield operation of an oilfield having a subterranean formation. The method includes collecting oilfield data and deploying a first plug-in including a first oilfield technology functionality into an oilfield hosting application. The method further includes performing an oilfield analysis on the collected oilfield data in the oilfield hosting application using the first oilfield technology functionality of the first plug-in to generate an oilfield output and adjusting an oilfield operation based on the oilfield output.

Other aspects and advantages of oilfield application frameworks will be apparent from the following description and the appended claims.

BRIEF DESCRIPTION OF DRAWINGS

So that the above described features of oilfield application frameworks can be understood in detail, a more particular description of oilfield application frameworks, briefly summarized above, may be had by reference to the embodiments thereof that are illustrated in the appended drawings. It is to be noted, however, that the appended drawings illustrate only typical embodiments and are therefore not to be considered limiting of its scope, for oilfield application frameworks may admit to other equally effective embodiments.

FIGS. 1.1-1.4 depict a simplified, schematic view of an oilfield having subterranean formations containing reservoirs therein, the various oilfield operations being performed on the oilfield.

FIGS. 4.1 and 4.2 depict oilfield applications for performing one or more oilfield operations.

FIG. 5 depicts a method for generating one or more oilfield applications.

DETAILED DESCRIPTION

Figure 2:
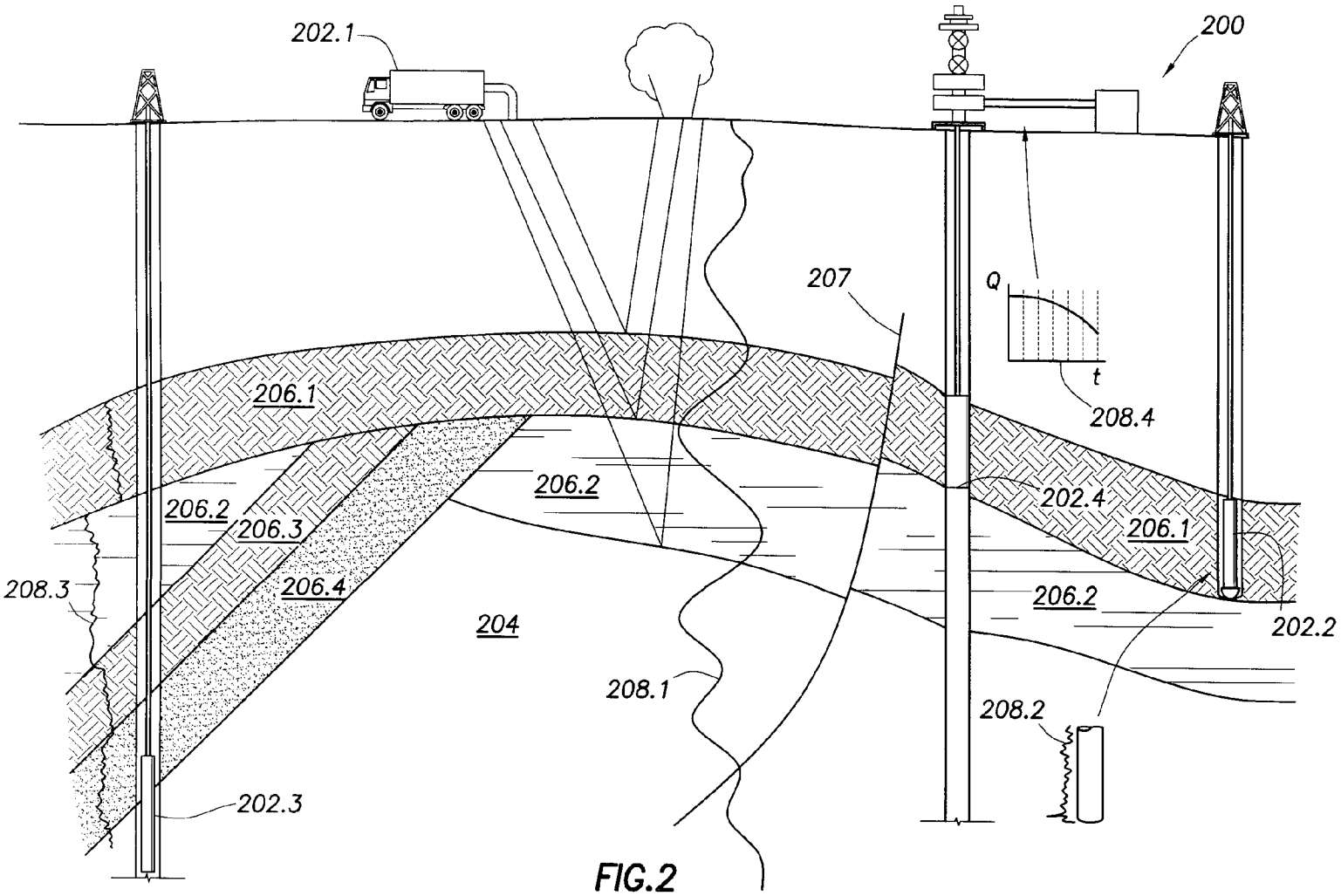
FIG. 2 is a schematic view, partially in cross section of an oilfield having a plurality of data acquisition tools positioned at various locations along the oilfield for collecting data from the subterranean formations.

Specific embodiments will now be described in detail with reference to the accompanying figures. Like elements in the various figures are denoted by like reference numerals for consistency.

In the following detailed description, numerous specific details are set forth in order to provide a more thorough understanding. In other instances, well-known features have not been described in detail to avoid obscuring embodiments of oilfield application frameworks.

FIGS. 1.1-1.4 depict simplified, representative, schematic views of a field 100 having a subterranean formation 102 containing a reservoir 104 therein and depicting various field operations being performed on the field 100. FIG. 1.1 depicts a survey operation being performed by a survey tool, such as seismic truck 106.1, to measure properties of the subterranean formation. The survey operation is a seismic survey operation for producing sound vibrations. In FIG. 1.1, one such sound vibration, a sound vibration 112 generated by a source 110, reflects off horizons 114 in the earth formation 116. A set of sound vibrations, such as the sound vibration 112 is received by sensors, such as geophone-receivers 118, situated on the earth's surface. The data received 120 is provided as input data to a computer 122.1 of a seismic truck 106.1, and responsive to the input data, computer 122.1 generates seismic data output 124. This seismic data output may be stored, transmitted or further processed as desired, for example, by data reduction.

FIG. 1.2 depicts a drilling operation being performed by drilling tools 106.2 suspended by a rig 128 and advanced into subterranean formations 102 to form a wellbore 136. Mud pit 130 is used to draw drilling mud into the drilling tools via a flow line 132 for circulating drilling mud down through the drilling tools, then up the wellbore 136 and back to the surface. The drilling mud is usually filtered and returned to the mud pit. A circulating system may be used for storing, controlling, or filtering the flowing drilling muds.

The drilling tools are advanced into the subterranean formations 102 to reach the reservoir 104. Each well may target one or more reservoirs. The drilling tools are adapted for measuring downhole properties using logging while drilling tools. The logging while drilling tools may also be adapted for taking core sample 133 as shown, or removed so that a core sample may be taken using another tool.

A surface unit 134 is used to communicate with the drilling tools and/or offsite operations, as well as with other surface or downhole sensors. The surface unit 134 is capable of communicating with the drilling tools to send commands to the drilling tools, and to receive data therefrom. The surface unit 134 collects data generated during the drilling operation and produces data output 135 which may be stored or transmitted. Computer facilities may be positioned at various locations about the field 100 (e.g., the surface unit 134) and/or at remote locations.

Sensors (S), such as gauges, may be positioned about the field 100 to collect data relating to various field operations as described previously. As shown, sensor (S) is positioned in one or more locations in the drilling tools and/or at the rig 128 to measure drilling parameters, such as weight on bit, torque on bit, pressures, temperatures, flow rates, compositions, rotary speed, and/or other parameters of the field operation. Sensors (S) may also be positioned in one or more locations in the circulating system.

The drilling tools 106.2 may include a bottom hole assembly (BHA) (not shown), generally referenced, near the drill bit (e.g., within several drill collar lengths from the drill bit). The bottom hole assembly includes capabilities for measuring, processing, and storing information, as well as communicating with the surface unit 134. The bottom hole assembly further includes drill collars for performing various other measurement functions.

The bottom hole assembly is provided with a communication subassembly that communicates with the surface unit 134. The communication subassembly is adapted to send signals to and receive signals from the surface using a communications channel such as mud pulse telemetry, electro-magnetic telemetry, or wired drill pipe communications. The communication subassembly may include, for example, a transmitter that generates a signal, such as an acoustic or electromagnetic signal, which is representative of the measured drilling parameters. It will be appreciated by one of skill in the art that a variety of telemetry systems may be employed, such as wired drill pipe, electromagnetic or other known telemetry systems.

Typically, the wellbore is drilled according to a drilling plan that is established prior to drilling. The drilling plan typically sets forth equipment, pressures, trajectories and/or other parameters that define the drilling process for the wellsite. The drilling operation may then be performed according to the drilling plan. However, as information is gathered, the drilling operation may need to deviate from the drilling plan. Additionally, as drilling or other operations are performed, the subsurface conditions may change. The earth model may also need adjustment as new information is collected The data gathered by sensors (S) may be collected by the surface unit 134 and/or other data collection sources for analysis or other processing. The data collected by sensors (S) may be used alone or in combination with other data. The data may be collected in one or more databases and/or transmitted on or offsite. The data may be historical data, real time data, or combinations thereof. The real time data may be used in real time, or stored for later use. The data may also be combined with historical data or other inputs for further analysis. The data may be stored in separate databases, or combined into a single database.

The surface unit 134 may be provided with a transceiver 137 to allow communications between the surface unit 134 and various portions of the field 100 or other locations. The surface unit 134 may also be provided with or functionally connected to one or more controllers (not shown) for actuating mechanisms at the field 100. The surface unit 134 may then send command signals to the field 100 in response to data received. The surface unit 134 may receive commands via the transceiver 137 or may itself execute commands to the controller. A processor may be provided to analyze the data (locally or remotely), make the decisions and/or actuate the controller. In this manner, the field 100 may be selectively adjusted based on the data collected. This technique may be used to optimize portions of the field operation, such as controlling drilling, weight on bit, pump rates, or other parameters. These adjustments may be made automatically based on computer protocol, and/or manually by an operator. In some cases, well plans may be adjusted to select optimum operating conditions, or to avoid problems.

FIG. 1.3 depicts a wireline operation being performed by a wireline tool 106.3 suspended by a rig 128 and into a wellbore 136 of FIG. 1.2. The wireline tool 106.3 is adapted for deployment into the wellbore 136 for generating well logs, performing downhole tests and/or collecting samples. The wireline tool 106.3 may be used to provide another method and apparatus for performing a seismic survey operation. The wireline tool 106.3 of FIG. 1.3 may, for example, have an explosive, radioactive, electrical, or acoustic energy source 144 that sends and/or receives electrical signals to surrounding subterranean formations 102 and fluids therein.

The wireline tool 106.3 may be operatively connected to, for example, geophones 118 and a computer 122.1 of a seismic truck 106.1 of FIG. 1.1. The wireline tool 106.3 may also provide data to the surface unit 134. The surface unit 134 collects data generated during the wireline operation and produces data output 135 that may be stored or transmitted. The wireline tool 106.3 may be positioned at various depths in the wellbore 136 to provide a survey or other information relating to the subterranean formation 102.

Sensors (S), such as gauges, may be positioned about the field 100 to collect data relating to various field operations as described previously. As shown, the sensor S is positioned in wireline tool 106.3 to measure downhole parameters which relate to, for example porosity, permeability, fluid composition and/or other parameters of the field operation.

FIG. 1.4 depicts a production operation being performed by a production tool 106.4 deployed from a production unit or Christmas tree 129 and into a completed wellbore 136 for drawing fluid from the downhole reservoirs into surface facilities 142. The fluid flows from a reservoir 104 through perforations in the casing (not shown) and into the production tool 106.4 in the wellbore 136 and to surface facilities 142 via a gathering network 146.

Sensors (S), such as gauges, may be positioned about the field 100 to collect data relating to various field operations as described previously. As shown, the sensor (S) may be positioned in the production tool 106.4 or associated equipment, such as Christmas tree 129, gathering network 146, surface facility 142, and/or the production facility, to measure fluid parameters, such as fluid composition, flow rates, pressures, temperatures, and/or other parameters of the production operation.

Production may also include injection wells (not shown) for added recovery. One or more gathering facilities may be operatively connected to one or more of the wellsites for selectively collecting downhole fluids from the wellsite(s).

While FIGS. 1.2-1.4 depict tools used to measure properties of a field, it will be appreciated that the tools may be used in connection with non-oilfield operations, such as gas fields, mines, aquifers, storage, or other subterranean facilities. Also, while certain data acquisition tools are depicted, it will be appreciated that various measurement tools capable of sensing parameters, such as seismic two-way travel time, density, resistivity, production rate, etc., of the subterranean formation and/or its geological formations may be used. Various sensors (S) may be located at various positions along the wellbore and/or the monitoring tools to collect and/or monitor the desired data. Other sources of data may also be provided from offsite locations.

The field configurations of FIGS. 1.1-1.4 are intended to provide a brief description of an example of a field usable with oilfield application frameworks. Part, or all, of the field 100 may be on land, water, and/or sea. Also, while a single field measured at a single location is depicted, oilfield application frameworks may be utilized with any combination of one or more fields, one or more processing facilities and one or more wellsites.

FIG. 2 is a schematic view, partially in cross section of field 200 having data acquisition tools 202.1, 202.2, 202.3 and 202.4 positioned at various locations along the field 200 for collecting data of the subterranean formation 204. Data acquisition tools 202.1-202.4 may be the same as data acquisition tools 106.1-106.4 of FIGS. 1.1-1.4, respectively, or others not depicted. As shown, data acquisition tools 202.1-202.4 generate data plots or measurements 208.1-208.4, respectively. These data plots are depicted along the field 200 to demonstrate the data generated by the various operations.

Data plots 208.1-208.3 are examples of static data plots that may be generated by data acquisition tools 202.1-202.3, respectively, however, it should be understood that data plots 208.1-208.3 may also be data plots that are updated in real time. These measurements may be analyzed to better define the properties of the formation(s) and/or determine the accuracy of the measurements and/or for checking for errors. The plots of each of the respective measurements may be aligned and scaled for comparison and verification of the properties.

Static data plot 208.1 is a seismic two-way response over a period of time. Static plot 208.2 is core sample data measured from a core sample of the formation 204. The core sample may be used to provide data, such as a graph of the density, porosity, permeability, or some other physical property of the core sample over the length of the core. Tests for density and viscosity may be performed on the fluids in the core at varying pressures and temperatures. Static data plot 208.3 is a logging trace that typically provides a resistivity or other measurement of the formation at various depths.

A production decline curve or graph 208.4 is a dynamic data plot of the fluid flow rate over time. The production decline curve typically provides the production rate as a function of time. As the fluid flows through the wellbore, measurements are taken of fluid properties, such as flow rates, pressures, composition, etc.

Other data may also be collected, such as historical data, user inputs, economic information, and/or other measurement data and other parameters of interest. As described below, the static and dynamic measurements may be analyzed and used to generate models of the subterranean formation to determine characteristics thereof. Similar measurements may also be used to measure changes in formation aspects over time.

The subterranean structure 204 has a plurality of geological formations 206.1-206.4. As shown, this structure has several formations or layers, including a shale layer 206.1, a carbonate layer 206.2, a shale layer 206.3 and a sand layer 206.4. A fault 207 extends through the shale layer 206.1 and the carbonate layer 206.2. The static data acquisition tools are adapted to take measurements and detect characteristics of the formations.

While a specific subterranean formation with specific geological structures is depicted, it will be appreciated that the field 200 may contain a variety of geological structures and/or formations, sometimes having extreme complexity. In some locations, typically below the water line, fluid may occupy pore spaces of the formations. Each of the measurement devices may be used to measure properties of the formations and/or its geological features. While each acquisition tool is shown as being in specific locations in the field 200, it will be appreciated that one or more types of measurement may be taken at one or more locations across one or more fields or other locations for comparison and/or analysis.

The data collected from various sources, such as the data acquisition tools of FIG. 2, may then be processed and/or evaluated. Typically, seismic data displayed in the static data plot 208.1 from the data acquisition tool 202.1 is used by a geophysicist to determine characteristics of the subterranean formations and features. The core data shown in the static plot 208.2 and/or log data from the well log 208.3 are typically used by a geologist to determine various characteristics of the subterranean formation. The production data from graph 208.4 is typically used by the reservoir engineer to determine fluid flow reservoir characteristics. The data analyzed by the geologist, geophysicist and the reservoir engineer may be analyzed using modeling techniques.

Figure 3:
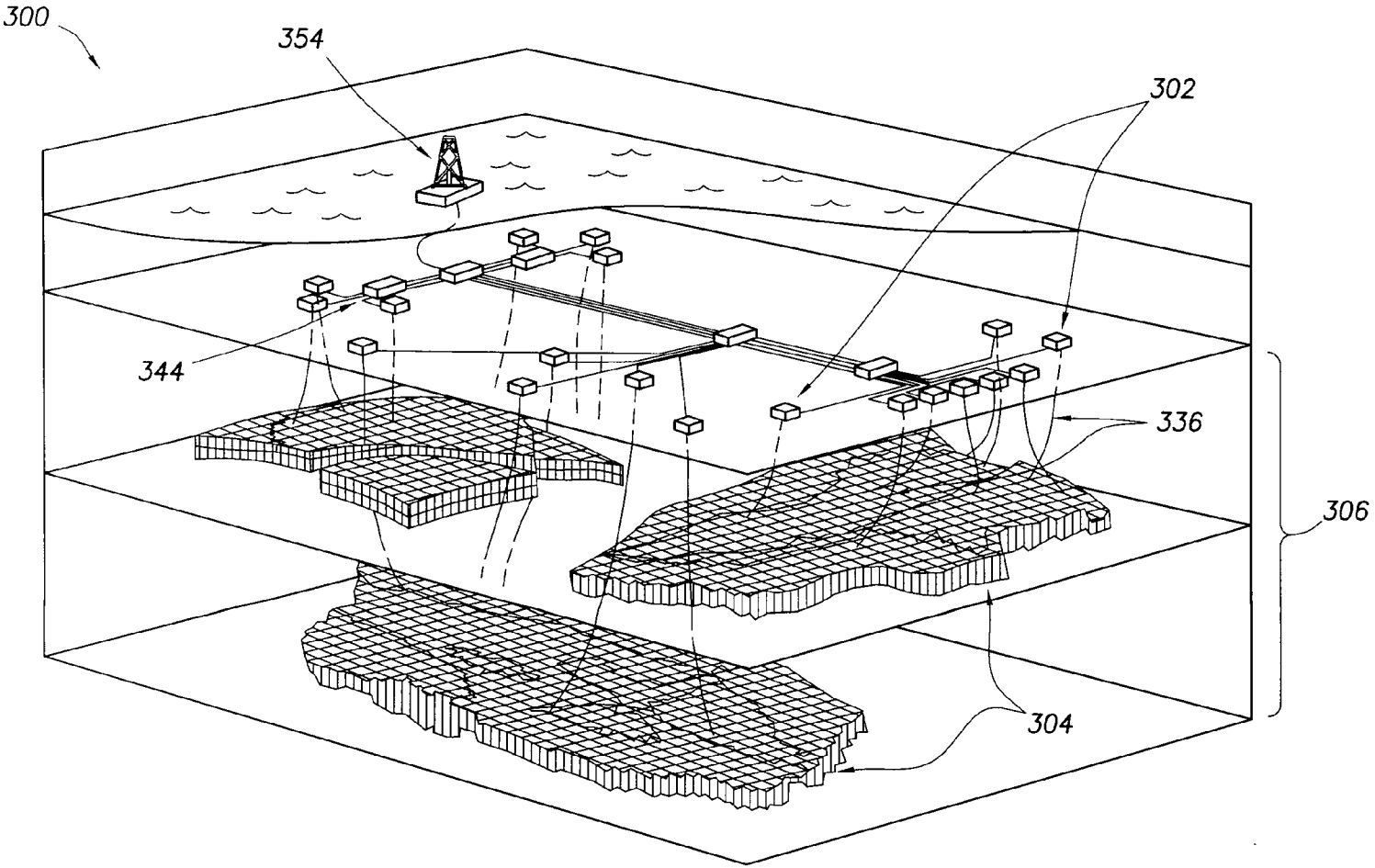
FIG. 3 depicts a production system for performing one or more oilfield operations.

FIG. 3 depicts an oilfield 300 for performing production operations. As shown, the oilfield has a plurality of wellsites 302 operatively connected to a central processing facility 354. The oilfield configuration of FIG. 3 is not intended to limit the scope of oilfield application frameworks. Part or all of the oilfield may be on land and/or sea. Also, while a single oilfield with a single processing facility and a plurality of wellsites is depicted, any combination of one or more oilfields, one or more processing facilities and one or more wellsites may be present.

Each wellsite 302 has equipment that forms a wellbore 336 into the earth. The wellbores extend through subterranean formations 306 including reservoirs 304. These reservoirs 304 contain fluids, such as hydrocarbons. The wellsites draw fluid from the reservoirs and pass them to the processing facilities via surface networks 344. The surface networks 344 have tubing and control mechanisms for controlling the flow of fluids from the wellsite to the processing facility 354.

FIG. 4.1 depicts a schematic view of an oilfield application 400 usable with the oilfield operation of, for example, those depicted in FIGS. 1.1-1.4, 2, and 3. The oilfield application 400 may be used with different phases of the oilfield operation, for example, during the development phase prior to drilling, during the drilling phase, during the production phase, etc. The oilfield application 400 includes an application shell 401, loading services 402, integration services 404 and application modules 406.1, 406.2, and 406.3. A data repository 408 may also be provided.

The application shell 401 is the basic structure for building an interface for forming an oilfield application 400. It may utilize a platform for creating an application. This platform provides basic building blocks for assembling the oilfield application 400. Additional functionality is typically provided to provision the platform for use in providing capabilities to the application shell 401 for performing oilfield operations. For example, the platform may be a system software capable of providing functionality for creating complex applications made of loosely coupled components, such that simple components may be combined to provide complex capabilities. The platform may allow these components to be independently developed, tested, and deployed. Exemplary platforms exist which are capable of creating complex user interfaces in a composite pattern. See, e.g., M. Szpuszta, *Designing Smart Clients Based on CAB and SCSF*, Microsoft Corporation, December 2006. In another example, the platform may have functionality for providing a consistent programming model for building applications while providing a separation between application functions, such as the user interface and the business logic. The platform may unify a host of application services for user interface (UI) and display function including but not limited to any of the following: UI button, UI menu, UI form, form filling paradigm, advanced selector, think ahead help, hierarchical data display, transparent layers, adaptive zooming paradigm, wireframe, storyboard, interactions to facilitate display on large or small devices, colorized composition, multiple data types for display, support for display component library, 2D and 3D drawing, fixed and adaptive documents, advanced typography, vector graphics, raster graphics, animation, data binding, audio, video, or any combinations thereof. Additional details of these application services are provided below.

The application shell 401 may be provided in a predefined format. The application shell 401, or at least a portion, may also be generated from a provided toolkit. Those skilled in the art will appreciate that a toolkit may correspond to a set of software tools configured to develop software applications. Furthermore, the application shell provider, the application module provider, and the oilfield application provider may be the same entity or different entities.

The application shell 401 may also be provided with constraints, requirements or other features, such as data, that assist in defining the oilfield application 400 for performing the oilfield operation. For example, the application shell 401 may provide user interface interaction and display services to the application modules 406.1, 406.2, and 406.3 to facilitate display on a variety of devices. The application shell 401 is adapted to receive the loaded and integrated application modules 406.1, 406.2, and 406.3 to form the oilfield application 400.

The application modules 406.1, 406.2, and 406.3 contain various oilfield sub-applications or tasks to be performed by the oilfield application 400. These application modules 406.1, 406.2, and 406.3 may be tools for performing tasks, such as generating reports, generating well plans, performing simulations, performing production operations, performing seismic operations, performing completions operations, performing drilling operations, etc. Some of these modules may be general modules with standard data formats and provide general functions reusable by different applications. These application modules 406.1, 406.2, and 406.3 may also be pre-existing sub-applications or applications created specifically for the oilfield applications 400.

The application modules 406.1, 406.2, and 406.3 are to be loaded and integrated into the application shell 401. The application shell 401 hosts the application modules 406.1, 406.2, and 406.3 by, for example, loading, starting and/or providing services that the modules require to operate. For example, the application shell 401 hosts application modules 406.1, 406.2, and 406.3 that may be configured to provide user interfaces, such as buttons, menus or other features, that permit the user to activate functionality of the oilfield application 400 or the application modules 406.1, 406.2, and 406.3. In this manner, the application shell 401 may selectively perform one or more of the tasks by selectively activating the various application modules 406.1, 406.2, and 406.3. The application modules 406.1, 406.2, and 406.3 may be activated simultaneously, sequentially and combinations thereof to provide the desired functions in the desired time frame(s) or sequence(s).

In addition to the user interface buttons and menus, the application shell 401 may also provide other features for use by the application modules 406.1, 406.2, and 406.3 to perform tasks for the oilfield operation. The features may include, but are not limited to, any of the following or any combinations thereof.

1. Form filling paradigm, i.e., the functions to reduce typing required for filing out data entry forms, e.g., an auto-completion function.

2. Advanced selector, which may be an element of the form filling paradigm, whereby the system uses the type of data to represent an alternative to typing in an answer. For example, the next logical depths for a trajectory in a well design on a graph/chart.

3. Think ahead help, which provides a help screen based on a context of the application.

4. Hierarchical data display for presenting parent and child relational elements, e.g., a data tree, table tree, etc.

5. Transparent layers, which are user interface elements displayed in an overlapping format with transparent upper layers allowing the deeper layers to be visible. In this case, the opacity or transparency of upper layers may be adjusted for improved data presentation.

6. Adaptive zooming paradigm for determining the size and shape of the display elements to accommodate the data context being represented. For example, in a small display device, one element may be zoomed in and others may be zoomed out while maintaining a scale that is still legible for the context.

To provide access to the application modules 406.1, 406.2, and 406.3 through the oilfield application 400, the modules are selectively loaded and/or integrated together either in a pre-determined format, dynamically as determined by the application modules or as directed, explicitly or implicitly, by the user as defined by the application shell 401. In some cases, the application modules 406.1, 406.2, and 406.3 may not be compatible with the application shell 401. Each such application module 406 may, therefore, need to be adapted for integration within the application shell 401. For example, some such application modules may require an adapter for compatibility with the application shell 401. As shown in FIG. 4.1, application modules 406.1 and 406.3 are encapsulated within an adapter 410.1 and 410.3, respectively, that presents an interface compatible with the application shell 401 and enables the application shell 401 to operate the application modules 406.1 and 406.3. The adapters 410.1 and 410.3 may be the same, or defined differently depending on the needs of the respective application modules 406.1 and 406.3 they encapsulate.

An application module (e.g., 406.1, 406.2, 406.3) is capable of performing functions in a predefined manner. In order to perform these functions via the application shell 401, the application module (e.g., 406.1, 406.2, 406.3) may be provided with the adapter such that the application module conforms to the requirements and/or expectations of the application shell 401. The application module (e.g., 406.1, 406.2, 406.3) is provided with functionality that may enable the application module (e.g., 406.1, 406.2, 406.3) to adapt to the application shell 401. In other words, the expectations of the application shell 401 are translated into those provided by the application module (e.g., 406.1, 406.2, 406.3). An adapter is provided to encapsulate the application module (e.g., 406.1, 406.2, 406.3). This adapter has an interface compatible with the application shell 401 and the application module (e.g., 406.1, 406.2, 406.3) to enable interoperability therebetween.

The adapter may be any interface capable of operatively linking the application modules 406.1, 406.2, and 406.3 with the application shell 401. For example, the adapter is provided with capabilities for selectively controlling the interaction between the application module (e.g., 406.1, 406.2, 406.3) and the application shell 401.

While the application modules 406.1, 406.2, and 406.3 are depicted as being separate application modules 406.1, 406.2, and 406.3 operatively linked to the application shell 401 via the integration services 404 and loading services 402, it will be appreciated that the application modules 406.1, 406.2, and 406.3 may be operatively linked prior to being linked with the application shell 401. This may be done, for example, by interfacing the application modules 406.1, 406.2, and 406.3 prior to attachment to the application shell 401. Some application modules 406.1, 406.2, and 406.3 may be separately designed for interaction and/or provided with the necessary interaction using the integration services 404 and loading services 402 as depicted.

The loading services 402 may be used to load the application module(s) 406.1, 406.2, and 406.3 into the application shell 401. Specifically, the loading services 402 may initialize, or activate, the application module (e.g., 406.1, 406.2, 406.3) in preparation for integration with one another and/or with the application shell 401. For example, in some cases, an un-initialized application module (e.g., 406.1, 406.2, 406.3) may not function in the application shell 401. In this example, the application modules 406.1, 406.2, and 406.3 may need to be activated prior to integration in order to function properly. Further, depending on the functionality of the tasks, some application modules (e.g., 406.1, 406.2, 406.3) may require initialization. The loading services 402 may also be used to establish any necessary connections with a data repository 408 (e.g., a database) needed to perform the task identified by the application module (e.g., 406.1, 406.2, 406.3).

The application module(s) 406.1, 406.2, and 406.3 may then be integrated with the application shell 401 so that the application module(s) 406.1, 406.2, and 406.3 may be controlled by the application user. Integration as used herein refers to the application modules 406.1, 406.2, and 406.3 discovery of the existence of other application modules 406.1, 406.2, and 406.3 and/or the provisioning of the integrated shell with interface elements for operation of the application modules 406.1, 406.2, and 406.3. The discovery of the existence of the application modules (e.g., 406.1, 406.2, 406.3) involves querying for the existence of application modules (e.g., 406.1, 406.2, 406.3). For example, a query may search for the application modules (e.g., 406.1, 406.2, 406.3) by name or function/type. Further, for any given function/type of application module (e.g., 406.1, 406.2, 406.3), multiple implementations may exist. Specific implementations may be bound to the application shell 401. The combined capabilities of the integrated application modules 406.1, 406.2, and 406.3 are greater than the sum of the capabilities of the application modules 406.1, 406.2, and 406.3 taken individually. A feature of integration services 404 is the ability for one application module (e.g., 406.1, 406.2, 406.3) to discover another application module by name. Once the application modules (e.g., 406.1, 406.2, 406.3) know about each other, the individual application modules (e.g., 406.1, 406.2, 406.3) may leverage off of the functionality of other application modules (e.g., 406.1, 406.2, 406.3). The interaction between the application modules 406.1, 406.2, and 406.3 enables the application modules 406.1, 406.2, and 406.3 to share data, perform simultaneous or consecutive function and generate synergistic results. The combined functionality of the application modules 406.1, 406.2, and 406.3 may be used to provide optimized oilfield operations.

The provisioning of the integrated shell with interface elements for operation of the application modules 406.1, 406.2, and 406.3 involves adding interface elements, such as menus, buttons or other user interface items, for controlling the operation of the application modules 406.1, 406.2, and 406.3. The application modules 406.1, 406.2, and 406.3 may then be selectively activated using these controls. These elements may also provide display features to textual and/or graphical displays of measurements, predictions, plans, operating parameters or other features of the oilfield. Examples of user interface and display features provided from the application shell 401 for use by the application modules 406.1, 406.2, and 406.3 may include form filling paradigm, advanced selector, think ahead help, hierarchical data display, transparent layers, adaptive zooming paradigm, wireframe, storyboard, interactions to facilitate display on large or small devices, colorized composition, multiple data types for display, support for display component library, 2D and 3D drawing, fixed and adaptive documents, advanced typography, vector graphics, raster graphics, animation, data binding, audio, video, or any combinations thereof.

After integrating the application modules 406.1, 406.2, and 406.3 together, the application modules 406.1, 406.2, and 406.3 can integrate themselves with the application shell 401. In this case, the application modules 406.1, 406.2, and 406.3 may create user interface elements that allow a user of the application to operate the application modules 406.1, 406.2, and 406.3. The user interface elements may include, for example, buttons, menu items and other displays.

The integration services 404 make the initialized application modules 406.1, 406.2, and 406.3 available to the application shell 401. The system may be automatic or manual. In cases, where user input is involved, an application module (e.g., 406.1, 406.2, 406.3) may provide user interface elements to activate capabilities of the application modules. The application modules 406.1, 406.2, and 406.3 may be formatted to operate within the application shell 401. Thus, once implemented within the application shell 401, the application modules 406.1, 406.2, and 406.3 are capable of performing their respective functions.

The application modules 406.1, 406.2, and 406.3 may be statically or dynamically loaded (and sometimes unloaded). In some cases, a first set of application modules 406.1, 406.2, and 406.3 may be loaded initially, and additional application modules may then be loaded at a later time to increase functionality. Once the application modules 406.1, 406.2, and 406.3 are incorporated into the application shell 401 according to the requirements, an oilfield application 400 is formed. The oilfield application 400 is configured to perform the tasks or functions defined by the oilfield application modules 406.1, 406.2, and 406.3. These tasks may be performed automatically or manually to complete the required oilfield operations. One or more application shells may be used to form the oilfield application 400. One or more application modules 406.1, 406.2, and 406.3 may be used to complete tasks for performing one or more oilfield operation(s). Examples of the tasks performed by the application modules 406.1, 406.2, and 406.3 may include business logic function such as generating reports, generating well plans, performing simulations, performing production operations, performing seismic operations, performing completions operations, and performing drilling operations.

It will be appreciated that there may be an interface between the application shell 400 and the integration services 404 or the loading services 402 that may be integrated in the integration services 404 or the loading services 402 or as a separate interface block (not shown). This interface and its implementation allow the integration services 404 and/or the loading services 402 to work with different application shells 400, such as a predefined application shell, an application shell generated from a toolkit, or an application shell provided by a different entity than the provider of the application modules (e.g., any of the application modules 406.1, 406.2, or 406.3).

Data may also be used during the oilfield application process. In some cases, the application shell 401 is provided with access to a data repository 408 (e.g., a database). In other cases, data is drawn in via the application modules 406.1, 406.2, and 406.3. A connection to the data source (e.g., a database connection) may be needed to selectively draw data into the oilfield application 400. The data may then be drawn into the oilfield application 400 via the application modules 406.1, 406.2, and 406.3, services and/or application shell 401 as desired. The data repository 408 or the data source may be integrated or have more than one storage component, local or remote, connected directly or through a network, or configured in other appropriate configurations.

Based on the displayed information, it may be desired to change various aspects of the oilfield operation and/or the oilfield application 400. For example, the results provided may indicate that a change at the oilfield is necessary or advantageous. The oilfield application 400 may also be adjusted, for example, by selecting different application modules 406.1, 406.2, and 406.3 and/or by changing the selective operation of the existing application modules 406.1, 406.2, and 406.3.

FIG. 4.2 is a schematic example of an oilfield application 450 for performing drilling oilfield operations. In this case, the drilling application shell 451 is provided with factors, such as constraints 452 and requirements 454. The constraints 452 determine the requirements for performing the oilfield operations. For example, drilling operations may require certain operating parameters, such as weight on bit, torque on bit, mud pressure and wellbore pressure. These constraints define the limitations that the oilfield application 450 and its underlying application modules or sub-applications will perform. In this manner, the oilfield application may 450 be restricted from permitting the wellbore to perform at unsafe or inefficient levels.

The requirements 454 relate to the operating format for the oilfield application 450. The oilfield application 450 may be defined to incorporate and/or process the various drilling application modules 456.1, 456.2, 456.3, 456.4, 464.5 in a specific manner. These drilling application modules 456.1, 456.2, 456.3, 456.4, 464.5 are loaded using the loading services 458, and integrated using the integration services 460.

For example, the well planning module 456.2 may be formatted to perform first, and provide outputs to the drilling controls module 456.4. In another example, the drilling monitoring module 456.3 may be formatted to send data to the drilling simulation module 456.1 to update well plans generated thereby. Reports may be generated by 464.5 throughout the process. The sequence of events performed by the oilfield application 450 is defined by the requirements 454. The requirements 454 may further provide for selective activation, data sharing, and interaction of the various application modules.

The various drilling modules are depicted as, but not limited to, drilling simulation 456.1, well planning 456.2, drilling monitoring 456.3, drilling controls 456.4, and drilling reports 464.5. These application modules may be in the form of pre-existing applications capable of performing various oilfield tasks. One or more of these drilling modules may be used to perform one or more oilfield operations during drilling. If desired, one or more of these application modules may be combined with other application modules to perform additional oilfield operations in a single application. For example, it may be desirable to perform economics simulation during the drilling operation to determine costs associated therewith. An economics simulation module may, therefore, also be included in the defined oilfield application.

The loading services 458 may be the same as the loading services 402 of FIG. 4.1. As shown, the loading services 458 are provided with various loading sub-services, such initialization services 462. These initialization services are used to initialize the sub-module in preparation for operation with the drilling application shell 451. Other loading sub-services may also be provided.

The integration services 460 may be the same as the integration services 404 of FIG. 4.1. As shown, the integration services 460 are provided with discovery subservices 468 and encapsulation subservices 470. Discovery subservice 468 is a service used to permit application modules to discover each other and cooperate. In some cases, the interface of the individual application modules must be adapted to comply with the drilling application shell 451. The encapsulating subservice provides an interface to allow the application modules to operate the drilling application shell 451. As shown, application modules 456.1, 456.2, 456.3 are encapsulated with adapters 472.1, 472.2, 472.3, respectively.

The drilling application generated from the drilling application shell 451 integrated application modules are used to perform the requested drilling oilfield operations. Once assembled, the drilling application may be used to selectively perform a group of individual drilling tasks, such as simulating drilling operations, developing a well plan, monitoring drilling operations, adjusting drilling operations, and generating drilling reports.

If desired data services module 462 can be provided. Data services may be provided by an application module capable of interacting with a data repository 464, such as a database or other persistent store. For an application module to use data services, the data service module may be discovered during the integration process.

A method 500 of performing an oilfield operation is depicted in FIG. 5. This method operation may be performed using an oilfield application, such as the ones depicted in FIGS. 4.1 and/or 4.2. This method may be tailored to the specific type of oilfield application, such as the drilling application of FIG. 4.2.

The oilfield application shell is created 502 to meet the needs of the oilfield operation(s). The application shell may be created as previously described with respect to the application shell 401 of FIG. 4.1. Thus, the application shell may be provided with requirements, constraints, data and additional functionality as desired.

A plurality of oilfield application modules is obtained 504. These application modules may be created or pre-existing oilfield application modules as previously described with respect to the application modules 406.1, 406.2, and 406.3 of FIG. 4.1. Each of the oilfield application modules is adapted to perform at least one oilfield task of the oilfield application.

The oilfield application modules are selectively integrated into the oilfield application shell 508. The oilfield application modules are formatted in a manner that permits them to operate properly via the oilfield application. Once loaded and integrated, the oilfield application is formed. The oilfield application may then be used to selectively perform the oilfield tasks 510 of the oilfield operation(s). Additional tasks, such as obtaining data may also be performed.

Examples of oilfield application frameworks have been focused, at least in part, on the generation of an oilfield application to selectively perform one or more oilfield tasks of an oilfield operation. In addition, an oilfield application may be considered as delivering, either directly or indirectly, oilfield technology functionality to an oilfield operation. The oilfield technology functionality delivered by an oilfield application may include, for example, advanced oilfield visualization techniques to view and analyze collected oilfield data, advanced oilfield access techniques to retrieve and/or store collected oilfield data from one or more oilfield repositories, advanced oilfield algorithms for calculations involving oilfield data, and advanced connectivity techniques to interoperate with other oilfield applications (i.e., external oilfield applications).

Further, examples of oilfield application frameworks have been focused primarily on an oilfield application being a standalone application. In some cases, an oilfield application, and the oilfield technology functionality delivered by the oilfield application, may be deployed as a plug-in to an oilfield hosting application performing an oilfield operation (discussed below).

Figure 6:
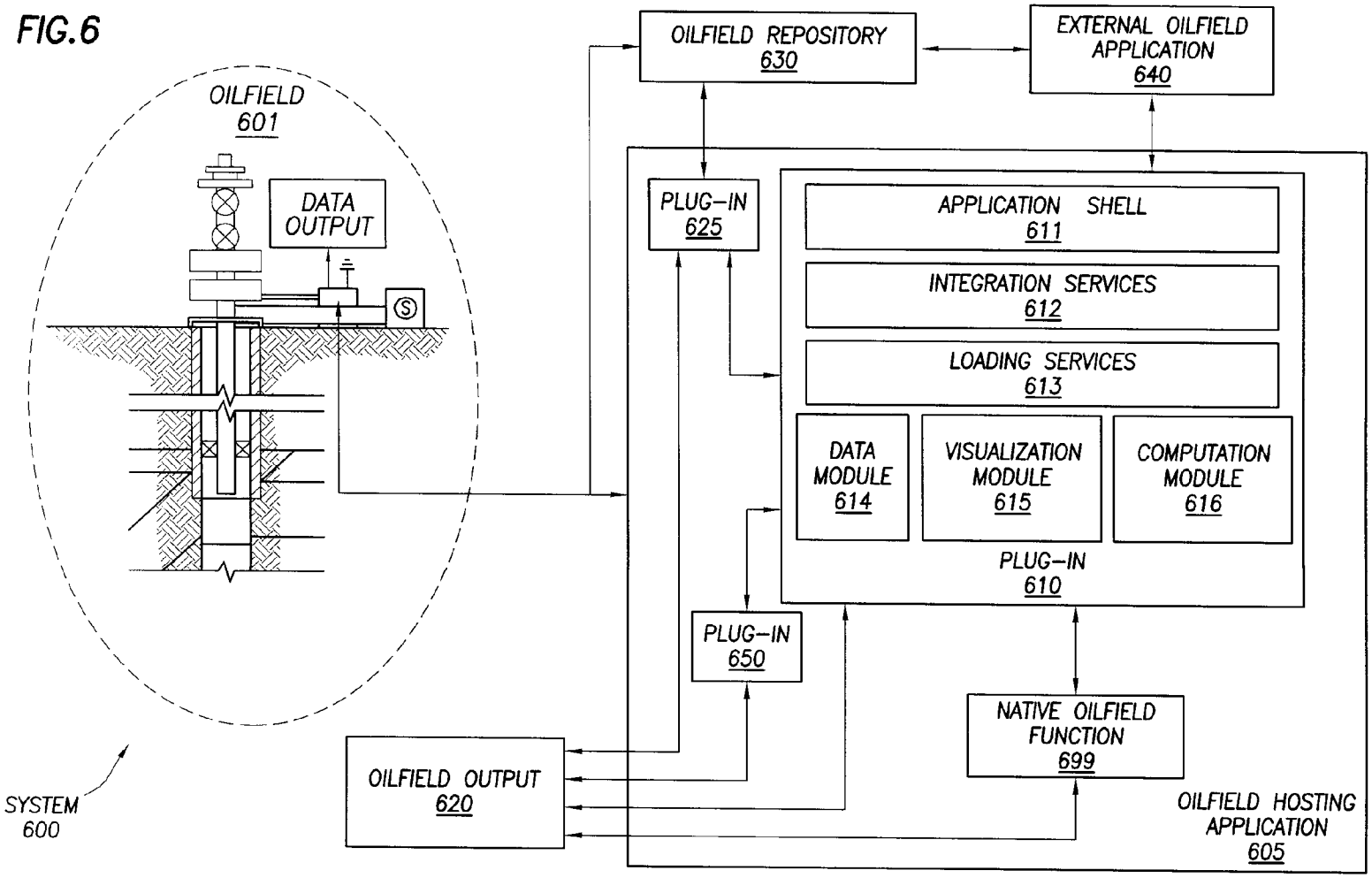
FIG. 6 depicts a system for performing one or more oilfield operations.

FIG. 6 depicts a system 600 for performing oilfield operations. For example, the system 600 may be used to perform one or more of the oilfield operations discussed above in reference to FIGS. 1.1-1.4, 2, and 3. As shown in FIG. 6, the system 600 has multiple components including an oilfield hosting application 605 operatively connected to an oilfield 601, an oilfield repository 630, and an external oilfield application 640. The oilfield 601 may be essentially the same as the oilfield 400, discussed above in reference to FIG. 4.

Still referring to FIG. 6, the oilfield hosting application 605 may be an oilfield application as discussed in U.S. Pat. No. 7,248,259 and/or U.S. Publication No. 2006/0197759. The oilfield hosting application 605 is configured to obtain data from the oilfield 601. For example, the oilfield hosting application 605 may obtain production and injection flow rates, production and injection pressures, well hardware, and/or completion information from the oilfield 601. The oilfield hosting application 605 may be an earth model simulation application, a drilling application, an oilfield economics application, a geophysics application, a production engineering application, an optimization application, a well analysis application, and/or a geoscience application.

The oilfield hosting application 605 is further configured to perform an oilfield analysis of oilfield data and generate an oilfield output 620. For example, the oilfield output 620 may be a production forecast for one or more wells in the oilfield based on the information received from the oilfield 601. In another example, the oilfield output 620 may be a model of one or more aspects of the oilfield 601.

In some cases, the oilfield hosting application 605 includes one or more oilfield applications (e.g., oilfield application 400 discussed above in reference to FIG. 4.1) deployed as one or more plug-ins (610, 625, 650). The plug-ins (610, 625, 650) add functionality to the oilfield hosting application 605. The oilfield hosting application 605 may include multiple application programming interfaces (APIs) providing the plug-ins (605, 625, 650) with comprehensive access to the application shell, menu, toolbars, business objects, data sources, and canvases of the oilfield hosting application 605.

As oilfield applications, the plug-ins (610, 625, 650) may include an application shell 611, integration services 612, loading services 613, and one or more application modules (e.g., data module 614, visualization module 615, and computation module 616) similar to the application shell 401, integration services 404, loading services 402, and application modules (406.1, 406.2, 406.3), respectively, as discussed above in reference to FIG. 4.1.

The application modules (625, 630, and 635) contain various oilfield sub-applications or tasks to be performed by the plug-in 610. The number and type of application modules associated with the plug-in 610 depend on the oilfield technology functionality delivered by the plug-in 610 to the oilfield hosting application 605 for generating the oilfield output 620. For example, the plug-in 625 may include a data services module (not shown) to provide the oilfield hosting application 605 with techniques for advanced oilfield to the oilfield repository 630. Similarly, a plug-in (e.g., plug-in 650) may include a visualization module (not shown) to provide the hosting application 605 with techniques for advanced visualization analysis of oilfield data. As an additional example, the plug-in (e.g., plug-in 650) may include a computation module (not shown) to provide the hosting application 605 with advanced algorithms for calculations involving oilfield data. Regardless of the oilfield technology functionality delivered by the plug-ins (e.g., 610, 625, 650) to the hosting application 605, the oilfield technology functionality may be used by the hosting application 605 to perform an oilfield analysis of oilfield data and generate the oilfield output 620.

The plug-ins (e.g., 610, 625, 650) operate seamlessly with other plug-ins (610, 625, 650) and may participate in the workflows of the oilfield hosting application 605. In addition, the plug-ins (e.g., 610, 625, 650) may operate seamlessly with and enhance existing functions (e.g., native oilfield function 699) of the oilfield hosting application 605.

Still referring to FIG. 6, in some cases, the plug-in 610 provides connectivity to interoperate the oilfield hosting application with the external oilfield application 640. Specifically, the plug-in 610 provides the oilfield hosting application 640 with access to the oilfield technology functionality and features of the external oilfield application 640. Accordingly, the oilfield hosting application 605 is able to use the oilfield technology functionality of the external application 640 to perform an oilfield analysis of the oilfield data and generate the oilfield output 620. The hosting application 605 may effectively be able to control the external application 640 using the plug-in 610.

Figure 7:
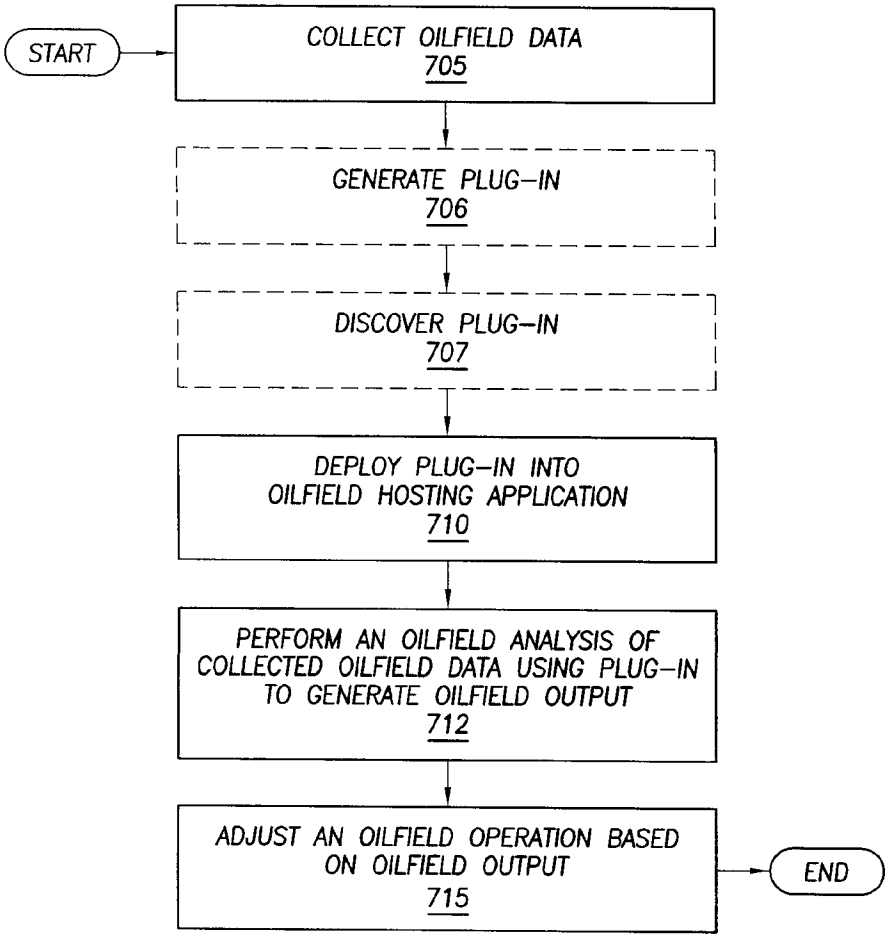

FIG. 7 depicts a method for performing oilfield operations. Some portions of FIG. 7 may be omitted or rearranged without departing from the scope of oilfield application frameworks.

Initially, oilfield data is collected (block 705). The oilfield data may arrive from an oilfield or may be retrieved from an oilfield repository. The oilfield data may be collected/retrieved by a oilfield hosting application. The oilfield data may include production and injection flow rates, production and injection pressures, well hardware, and/or completion information.

Optionally, in block 706, a plug-in is generated from a toolkit. Specifically, generating the plug-in may include generating an application shell, or at least a portion, from a provided toolkit as discussed above with respect to FIG. 4. At this stage, application modules may be discovered and integrated into the application shell (block 707). In this case, the application shell is included in the plug-in for use by oilfield hosting applications, where the application modules integrated into the application shell are configured to perform one or more oilfield functions. Those skilled in the art will appreciate that any number of application modules may be integrated into an application shell, where each application module provides a distinct oilfield function.

In block 710, a plug-in is deployed into the oilfield hosting application. The plug-in may be an oilfield application for use in performing one or more oilfield functions on a particular machine designed for such. Said oilfield application may include the application shell, integration services, loading services, and one or more application modules for use in performing the one or more oilfield operations. When deployed as a plug-in to the oilfield hosting application, the oilfield application delivers oilfield technology functionality to the oilfield hosting application.

In one or more embodiments of the invention, blocks 706-710 may be repeated to deploy multiple plug-ins into the oilfield hosting application. For example, the oilfield hosting application may be configured to discovery and integrate any number of plug-ins, where each plug-in provides distinct oilfield technology functionality. In another example, a first plug-in may be configured to discover and integrate additional plug-ins into the oilfield hosting application and/or the first plug-in, where the additional plug-ins include additional oilfield technology functionality.

In block 712, the oilfield hosting application performs an oilfield analysis of the collected oilfield data using the plug-in(s). The oilfield analysis generates an oilfield output. Specifically, the oilfield hosting application performs an oilfield analysis and generates the oilfield output using the oilfield technology functionality provided by the plug-in(s). The oilfield technology functionality may include advanced techniques to for visualizing and analyzing collected oilfield data, advanced techniques for accessing collected oilfield data from one or more oilfield repositories, advanced oilfield algorithms for calculations involving oilfield data, and/or advanced techniques for connecting with other oilfield applications (i.e., oilfield applications external to the oilfield hosting application).

Still referring to block 712, the oilfield output may be a production forecast for one or more wells in the oilfield based on the information received from the oilfield. The oilfield output may also be a model of one or more features of the oilfield.

In block 715, an oilfield operation is adjusted based on the oilfield output. The oilfield operation may be a surveying operation, a drilling operation, a wireline testing operation, a production operation, a planning operation, etc.

Figure 8:
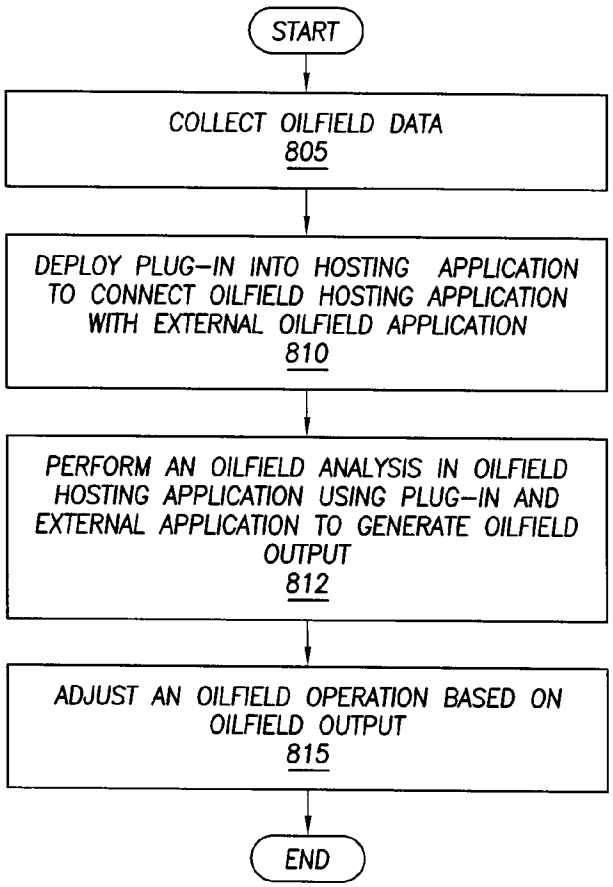
FIGS. 7 and 8 depict methods for performing one or more oilfield operations.

FIG. 8 depicts a method for performing an oilfield operation. Some portions of FIG. 8 may be omitted or rearranged without departing from the scope of oilfield application frameworks.

Initially, oilfield data is collected (block 805). The oilfield data may arrive from an oilfield or may be retrieved from an oilfield repository. The oilfield data may be collected/retrieved by a oilfield hosting application. The oilfield data may include production and injection flow rates, production and injection pressures, well hardware, and/or completion information.

In block 810, the plug-in is deployed into the oilfield hosting application executing on a particular machine adapted to perform, analyze, or interpret one or more oilfield functions. The plug-in may be used to connect the oilfield hosting application with an external application. In other words, the plug-in effectively provides the oilfield hosting application access to the oilfield technology functionality of the external oilfield application. The oilfield technology functionality provided by the external oilfield application may include advanced techniques for visualizing and analyzing collected oilfield data, advanced techniques for accessing collected oilfield data from one or more oilfield repositories, and/or advanced oilfield algorithms for calculations involving oilfield data. The external oilfield application may include an application shell, integration services, loading services, and one or more application modules for use in performing one or more oilfield functions.

In block 812, the oilfield hosting application performs an oilfield analysis of the collected oilfield data. The oilfield analysis generates an oilfield output and is performed using the oilfield technology functionality of the external oilfield application. For example, the oilfield output may be a production forecast for one or more wells in the oilfield based on the information received from the oilfield. In another example, the oilfield output may also be a model of one or more features of the oilfield.

In block 815, an oilfield operation is adjusted based on the oilfield output. The oilfield operation may be a surveying operation, a drilling operation, a wireline testing operation, a production operation, a planning operation, etc.

Figure 9:
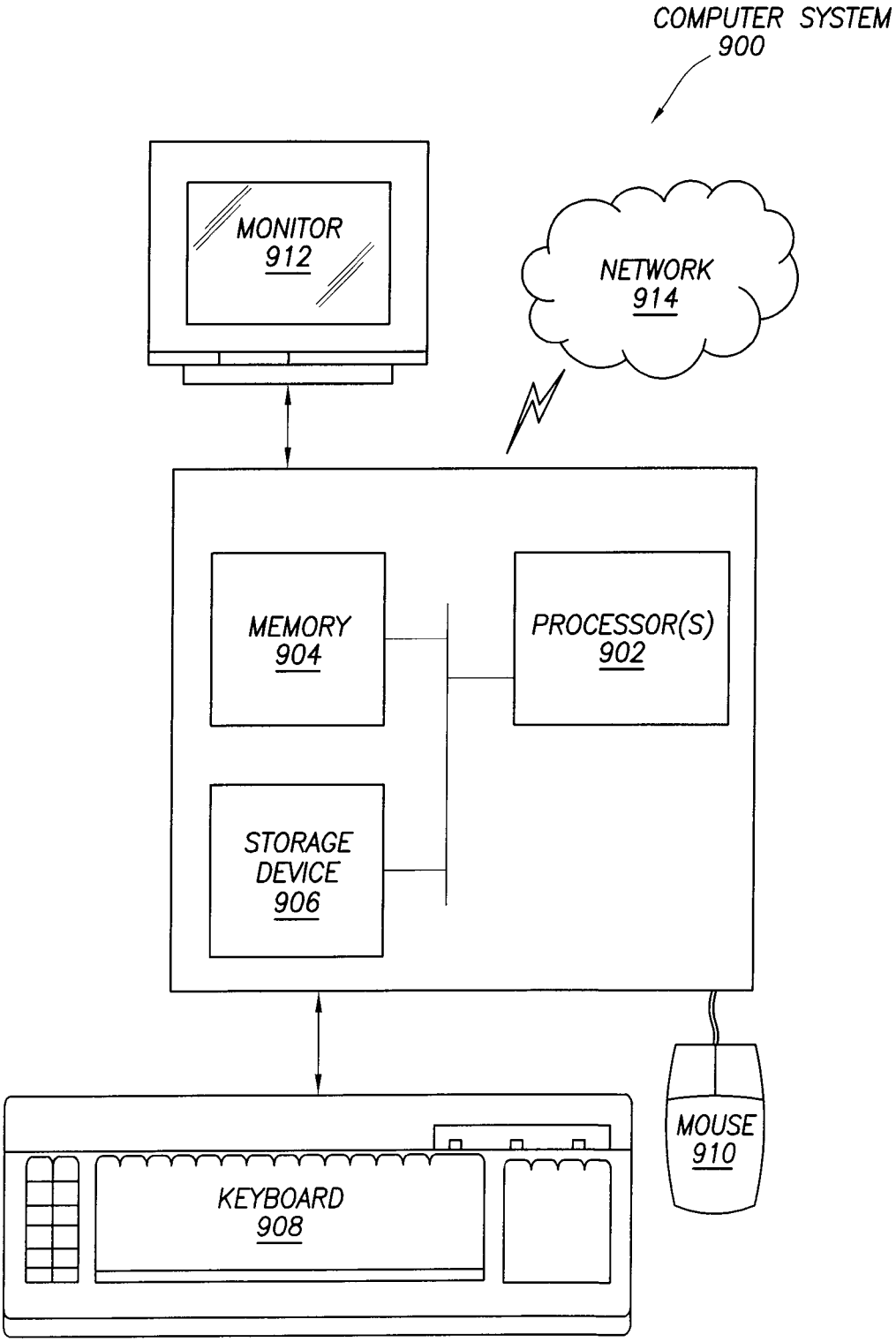
FIG. 9 depicts an example computer system into which implementations of various techniques described herein may be implemented in accordance with one or more embodiments.

Embodiments of oilfield application frameworks (or portions thereof), may be implemented on virtually any type of computer regardless of the platform being used. For example, as shown in FIG. 9, a computer system 900 includes one or more processor(s) 902, associated memory 904 (e.g., random access memory (RAM), cache memory, flash memory, etc.), a storage device 906 (e.g., a hard disk, an optical drive such as a compact disk drive or digital video disk (DVD) drive, a flash memory stick, etc.), and numerous other elements and functionalities typical of modern computers (not shown). The computer system 900 may also include input means, such as a keyboard 908, a mouse 910, or a microphone (not shown). Further, the computer system 900 may include output means, such as a monitor 912 (e.g., a liquid crystal display (LCD), a plasma display, or cathode ray tube (CRT) monitor). The computer system 900 may be connected to a network (914) (e.g., a local area network (LAN), a wide area network (WAN) such as the Internet, or any other similar type of network) with wired and/or wireless segments via a network interface connection (not shown). Those skilled in the art will appreciate that many different types of computer systems exist, and the aforementioned input and output means may take other forms. Generally speaking, the computer system 900 includes at least the minimal processing, input, and/or output means necessary to practice one or more embodiments.

Further, those skilled in the art will appreciate that one or more elements of the aforementioned computer system 900 may be located at a remote location and connected to the other elements over a network. Further, one or more embodiments may be implemented on a distributed system having a plurality of nodes, where each portion may be located on a different node within the distributed system. In one or more embodiments, the node corresponds to a computer system. Alternatively, the node may correspond to a processor with associated physical memory. The node may alternatively correspond to a processor with shared memory and/or resources. Further, software instructions for performing one or more embodiments of oilfield application frameworks may be stored on a computer readable medium such as a compact disc (CD), a diskette, a tape, or any other computer readable storage device.

The systems and methods provided relate to the acquisition of hydrocarbons from an oilfield. It will be appreciated that the same systems and methods may also be used for performing subsurface operations, such as mining, water retrieval and acquisition of other underground materials.

While specific configurations of systems for performing oilfield operations are depicted, it will be appreciated that various combinations of the described systems may be provided. For example, various combinations of selected modules may be connected using the connections previously described. One or more modeling systems may be combined across one or more oilfields to provide tailored configurations for modeling a given oilfield or portions thereof. Such combinations of modeling may be connected for interaction therebetween. Throughout the process, it may be desirable to consider other factors, such as economic viability, uncertainty, risk analysis and other factors. It is, therefore, possible to impose constraints on the process. Modules may be selected and/or models generated according to such factors. The process may be connected to other model, simulation and/or database operations to provide alternative inputs.

It will be understood from the foregoing description that various modifications and changes may be made in the embodiments of oilfield application frameworks without departing from its true spirit. For example, during a real-time drilling of a well it may be desirable to update the oilfield model dynamically to reflect new data, such as measured surface penetration depths and lithological information from the real-time well logging measurements. The oilfield model may be updated in real-time to predict the location in front of the drilling bit. Observed differences between predictions provided by the original oilfield model concerning well penetration points for the formation layers may be incorporated into the predictive model to reduce the chance of model predictability inaccuracies in the next portion of the drilling process. In some cases, it may be desirable to provide faster model iteration updates to provide faster updates to the model and reduce the chance of encountering and expensive oilfield hazard.

This description is intended for purposes of illustration only and should not be construed in a limiting sense. The scope of oilfield application frameworks should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A system comprising:

one or more processors;

memory; and an earth model application stored in the memory and executable by the processor;

a hosting application stored in the memory and executable by the processor wherein the hosting application comprises:

an application shell comprising a first application programming interface for plug-in access to the earth model application, a data source integration service accessible by the application shell wherein the data source integration service comprises a second application programming interface for plug-in access to the data source integration service, and an application display service accessible by the application shell wherein the application display service comprises a third application programming interface for plug-in access to the application display service; and instructions stored in the memory and executable by the processor to:

load the earth model application into the application shell, wherein the earth model application comprises native functionality of the hosting application;

generate a plug-in, comprising:

generating, from a toolkit of the hosting application, a portion of the application shell for the plug-in; and loading, in response to the generating the portion of the application shell and in response to discovering a computation module from the toolkit, the computation module into the application shell, the computational module configured to enhance the native functionality of the hosting application; and deploy the plug-in into the hosting application, wherein the earth model application, the data source integration service, and the application display service are accessible to the plug-in via the first application programming interface, the second application programming interface, and the third application programming interface.

2. The system of claim 1 wherein the hosting application comprises an oilfield hosting application and wherein the earth model application comprises native oilfield functionality for the oilfield hosting application.

3. The system of claim 1 wherein the earth model application comprises modules.

4. The system of claim 3 wherein the modules comprise modules for generating an earth model.

5. The system of claim 4 wherein the earth model comprises a simulation model.

6. The system of claim 3 wherein the hosting application comprises a loading service for loading the modules of the earth model application into the application shell.

7. The system of claim 1 further comprising the plug-in configured to access the earth model application via the first application programming interface of the application shell.

8. The system of claim 1 further comprising the plug-in configured to access the data source integration service via the second application programming interface of the data source integration service.

9. The system of claim 1 further comprising the plug-in configured to access the application display service via the third application programming interface of the application display service.

10. The system of claim 4 further comprising the plug-in configured to access the earth model via the first application programming interface of the application shell, configured to access the data source integration service via the second application programming interface of the data source integration service and configured to access the application display service via the third application programming interface of the application display service.

11. A method comprising:

providing an earth model application;

providing a hosting application that comprises:

an application shell comprising a first application programming interface for plug-in access to the earth model application, a data source integration service accessible by the application shell wherein the data source integration service comprises a second application programming interface for plug-in access to the data source integration service, and an application display service accessible by the application shell wherein the application display service comprises a third application programming interface for plug-in access to the application display service;

loading the earth model application into the application shell, wherein the earth model application comprises native functionality of the hosting application;

generating a plug-in, comprising:

generating, from a toolkit of the hosting application, a portion of the application shell for the plug-in; and loading, in response to the generating the portion of the application shell and in response to discovering a computation module from the toolkit, the computation module into the application shell, the computational module configured to enhance the native functionality of the hosting application; and deploying the plug-in into the hosting application, wherein the earth model application, the data source integration service, and the application display service are accessible to the plug-in via the first application programming interface, the second application programming interface, and the third application programming interface.

12. The method of claim 11 wherein the hosting application comprises an oilfield hosting application and wherein the earth model application comprises native oilfield functionality for the oilfield hosting application.

13. The method of claim 11 further comprising performing a workflow at least in part by accessing the earth model application via the first application programming interface using the plug-in.

14. The method of claim 11 further comprising accessing the earth model application via the first application programming interface using the plug-in and enhancing functionality of the earth model application using the plug-in.

15. The method of claim 11 further comprising performing a workflow using the plug-in configured to access at least one of the first, second, and third application programming interfaces.

16. The method of claim 11 further comprising generating an earth model of a subterranean formation using the earth model application at least in part by accessing a data source via the data source integration service.

17. The method of claim 16 wherein the data source comprises measurement data.

18. The method of claim 17 wherein the measurement data comprises at least one of static measurement data and dynamic measurement data.

19. One or more non-transitory computer-readable media comprising computer-executable instructions for:

an earth model application;

a hosting application that comprises:

an application shell comprising a first application programming interface for plug-in access to the earth model application, a data source integration service accessible by the application shell wherein the data source integration service comprises a second application programming interface for plug-in access to the data source integration service, and an application display service accessible by the application shell wherein the application display service comprises a third application programming interface for plug-in access to the application display service; and causing, when executed, a computer processor to:

load the earth model application into the application shell, wherein the earth model application comprises native functionality of the hosting application;

generate a plug-in, comprising:

generating, from a toolkit of the hosting application, a portion of the application shell for the plug-in; and loading, in response to the generating the portion of the application shell and in response to discovering a computation module from the toolkit, the computation module into the application shell, the computational module configured to enhance the native functionality of the hosting application; and deploy the plug-in into the hosting application, wherein the earth model application, the data source integration service, and the application display service are accessible to the plug-in via the first application programming interface, the second application programming interface, and the third application programming interface.

20. The one or more non-transitory computer-readable media of claim 19 wherein the hosting application comprises an oilfield hosting application and wherein the earth model application comprises native oilfield functionality for the oilfield hosting application.

* * * * *